US010279493B2

(12) United States Patent
Snow

(10) Patent No.: US 10,279,493 B2
(45) Date of Patent: May 7, 2019

(54) VACUUM SYSTEMS FOR HAIR CLIPPERS

(71) Applicant: WAHL CLIPPER CORPORATION, Sterling, IL (US)

(72) Inventor: Gary Snow, Rock Falls, IL (US)

(73) Assignee: Wahl Clipper Corporation, Sterling, IL (US)

( * ) Notice: Subject to any disclaimer, the term of this patent is extended or adjusted under 35 U.S.C. 154(b) by 100 days.

(21) Appl. No.: 15/474,742

(22) Filed: Mar. 30, 2017

(65) Prior Publication Data

US 2018/0281214 A1 Oct. 4, 2018

(51) Int. Cl.

| | |
|---|---|
| ***B26B 19/44*** | (2006.01) |
| ***B26B 19/06*** | (2006.01) |
| ***B26B 19/38*** | (2006.01) |

(52) U.S. Cl.

CPC ..... *B26B 19/44* (2013.01); *B26B 19/06* (2013.01); *B26B 19/3886* (2013.01)

(58) Field of Classification Search

CPC ..... B26B 19/44; B26B 19/06; B26B 19/3886
USPC ..... 30/34.1, 133, 527, 216, 210, 195; 285/7
See application file for complete search history.

(56) References Cited

U.S. PATENT DOCUMENTS

| | | | | |
|---|---|---|---|---|
| 1,572,644 | A | 2/1926 | Farnsworth | |
| 2,323,046 | A | 6/1943 | Jenkins | |
| 2,716,279 | A | 8/1955 | Peterson | |
| 2,802,260 | A | 8/1957 | Allen | |
| 2,916,821 | A | 12/1959 | Witmer | |
| 2,946,123 | A | 7/1960 | Bray | |
| 3,035,346 | A | 5/1962 | Campbell | |
| 3,369,294 | A * | 2/1968 | Shaw | B26B 19/40 30/346.51 |
| 3,604,112 | A | 9/1971 | Bhavnani | |
| 3,611,566 | A | 10/1971 | Brennan, Sr. | |
| 3,699,652 | A | 10/1972 | Deverman et al. | |

(Continued)

FOREIGN PATENT DOCUMENTS

| | | |
|---|---|---|
| DE | 3330741 | 3/1985 |
| DE | 19508462 | 9/1995 |

(Continued)

OTHER PUBLICATIONS

Wahl Clipper Corporation's Request for Ex Parte Reexamination of claims 1-15 of U.S. Pat. No. 6,978,547.

(Continued)

*Primary Examiner* — Ghassem Alie
*Assistant Examiner* — Nhat Chieu Q Do
(74) *Attorney, Agent, or Firm* — Greer Burns & Crain, Ltd.

(57) ABSTRACT

A hair clipper has a vacuum system for collecting hair debris created by the cutting blades. Air flow through an adjustable air inlet is divided into multiple paths, including at least one primary flow path and at least one separate secondary flow path. A debris trap intersects both the primary air flow path and the secondary air flow path. The primary flow path allows air flow through a first path to be higher than a secondary air flow through the second path before debris accumulates in the debris trap. The primary air flow decreases as debris accumulates in the primary air flow path and the secondary air flow approaches and perhaps exceeds the primary air flow, whereupon some debris accumulates in the secondary air flow path as air is diverted through the secondary air flow path.

6 Claims, 10 Drawing Sheets

(56) References Cited

U.S. PATENT DOCUMENTS

| | | | | |
|---|---|---|---|---|
| 4,219,931 | A | 9/1980 | Vacilotto | |
| 4,314,405 | A | 2/1982 | Park | |
| 4,417,397 | A | 11/1983 | Kitamura | |
| 4,581,822 | A | 4/1986 | Fujimura | |
| 4,622,745 | A | 11/1986 | Wahl | |
| D294,407 | S | 2/1988 | Ullmann | |
| 4,776,095 | A | 10/1988 | Tsujimoto et al. | |
| 5,012,576 | A | 5/1991 | Johannesson | |
| 5,050,305 | A | 9/1991 | Baker et al. | |
| 5,075,971 | A | 12/1991 | McCambridge | |
| 5,084,974 | A | 2/1992 | Sukow et al. | |
| 5,724,736 | A | 3/1998 | Smith | |
| 5,970,616 | A * | 10/1999 | Wahl | B26B 19/063 30/199 |
| 6,261,161 | B1 | 7/2001 | Yan | |
| D472,674 | S | 4/2003 | Long et al. | |
| 6,546,592 | B1 * | 4/2003 | Cockburn | A47L 5/24 15/344 |
| 6,665,938 | B2 | 12/2003 | McCambridge et al. | |
| 6,684,511 | B2 | 2/2004 | McCambridge et al. | |
| 6,739,053 | B2 | 5/2004 | McCambridge et al. | |
| 6,934,994 | B2 * | 8/2005 | Oh | A47L 9/1409 15/327.1 |
| 6,978,547 | B2 | 12/2005 | Degregorio, Jr. | |
| 6,986,206 | B2 | 1/2006 | McCambridge et al. | |
| 7,076,878 | B2 | 7/2006 | Degregorio, Jr. | |
| 8,484,853 | B1 * | 7/2013 | Laube | B26B 19/44 30/133 |
| 2002/0073549 | A1 | 6/2002 | McCambridge et al. | |
| 2006/0042103 | A1 * | 3/2006 | Chasen | A45D 27/46 30/537 |
| 2006/0162516 | A1 | 7/2006 | Andis et al. | |
| 2006/0230619 | A1 * | 10/2006 | Williams | B26B 19/44 30/133 |
| 2011/0308035 | A1 | 12/2011 | Casper | |

FOREIGN PATENT DOCUMENTS

| | | |
|---|---|---|
| EP | 1 216 799 B1 | 6/2005 |
| JP | 3005899 | 1/1991 |
| JP | H7-51472 | 2/1995 |
| JP | H11-76646 | 3/1999 |
| JP | 2000-61174 | 2/2000 |
| WO | WO 95/33600 | 12/1995 |
| WO | WO 2004/002690 A1 | 1/2004 |

OTHER PUBLICATIONS

EP Search Report issued in EP App. No. 18 16 4221, dated Sep. 5, 2018.

* cited by examiner

VACUUM SYSTEMS FOR HAIR CLIPPERS

This invention relates to vacuum systems for hair clippers, and more particularly, to debris traps for hair clipper vacuum systems, and adjustable air inlets for hair clipper vacuum systems.

BACKGROUND OF THE INVENTION

Conventional vacuum systems for hair clippers have a debris trap that catches hair fragments as the hair is cut. However, airflow decreases as debris accumulates in the trap, which reduces airflow and inhibits waste accumulation Thus, there is a need for debris traps that maintain better waste accumulation as the trap fills with debris.

Hair clippers and trimmers sometime create cut long hair strands. At other times, they create small debris, such as beard stubble. Conventional vacuum systems for hair clippers have a fixed air inlet adjacent the cutting blades to catch all of the debris. However, a large air inlet draws large debris well, but small debris can be lost because negative air pressure at the inlet is relatively low. A small air inlet creates a strong vacuum, which attracts small hair particles, but longer hair can get stuck in the air inlet, because it is small. Accordingly, there is a need for air inlets for vacuum systems for hair clippers that can be adjusted to collect different types of debris well.

Accordingly, one object of this invention is to provide a new and improved vacuum system debris trap for hair clippers that maintain better waste accumulation as the trap fills with debris.

Another object is to provide vacuum systems for hair clippers that collect different types of debris well.

SUMMARY OF THE INVENTION

In keeping with one aspect of this invention, a hair clipper has a housing, cutting blades secured to the housing outside of the housing, and a vacuum system for collecting hair debris created by the cutting blades. An air flow generator such as a motor with a fan is provided in the housing. An air inlet adjacent the cutting blades leads inside the housing, the air flow generator creating a total air flow that draws air from the cutting blades into the housing.

Inside the housing, the total air flow is divided into multiple paths, including at least one primary flow path and at least one separate secondary flow path. The housing has at least one air exhaust opening through which the total air flow is released after the air passes the air flow generator.

A debris trap is located between the air flow generator and the air inlet. The debris trap intersects both the primary air flow path and the secondary air flow path. The primary flow path has an effective primary opening that is larger than an effective secondary opening in the secondary airflow path, which can be one or more actual paths.

The primary flow path is preferably in a straight line from the air inlet to the air flow generator, which together with the larger primary opening, allows air flow through the first path to be higher than a secondary air flow through the second path before debris accumulates in the debris trap. The primary air flow decreases as debris accumulates in the primary air flow path and the secondary air flow approaches and perhaps exceeds the primary air flow, whereupon some debris accumulates in the secondary air flow path as air is diverted through the secondary air flow path.

In keeping with another aspect of the invention, the air inlet adjacent the cutting blades can be adjustable to selectively present a small opening for higher air flow and better trapping of small debris, and a larger opening for collecting relatively large debris when needed.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1A:
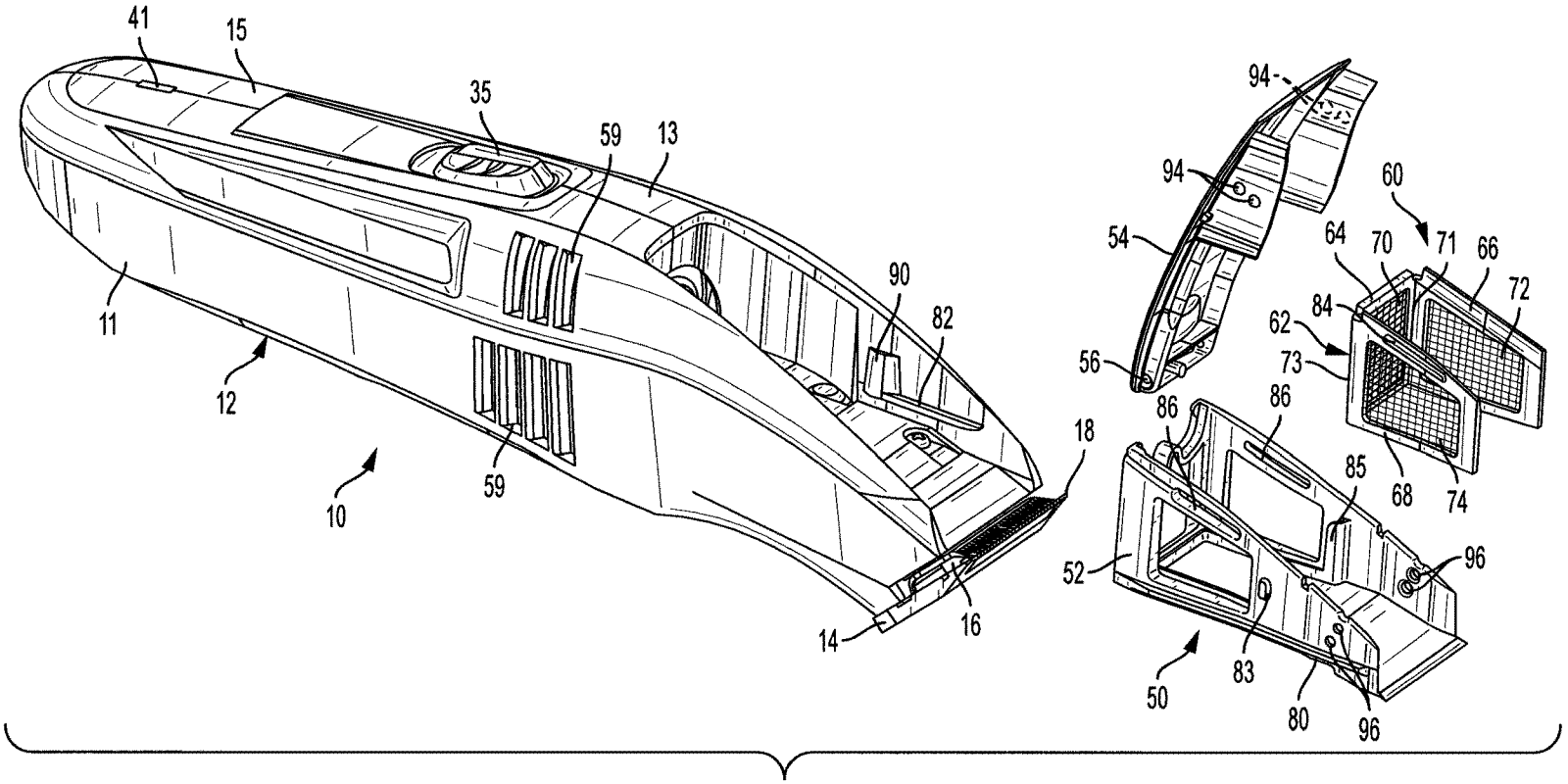
FIG. 1A is an exploded view of an embodiment of a hair clipper according to the present invention.
Figure 1B:
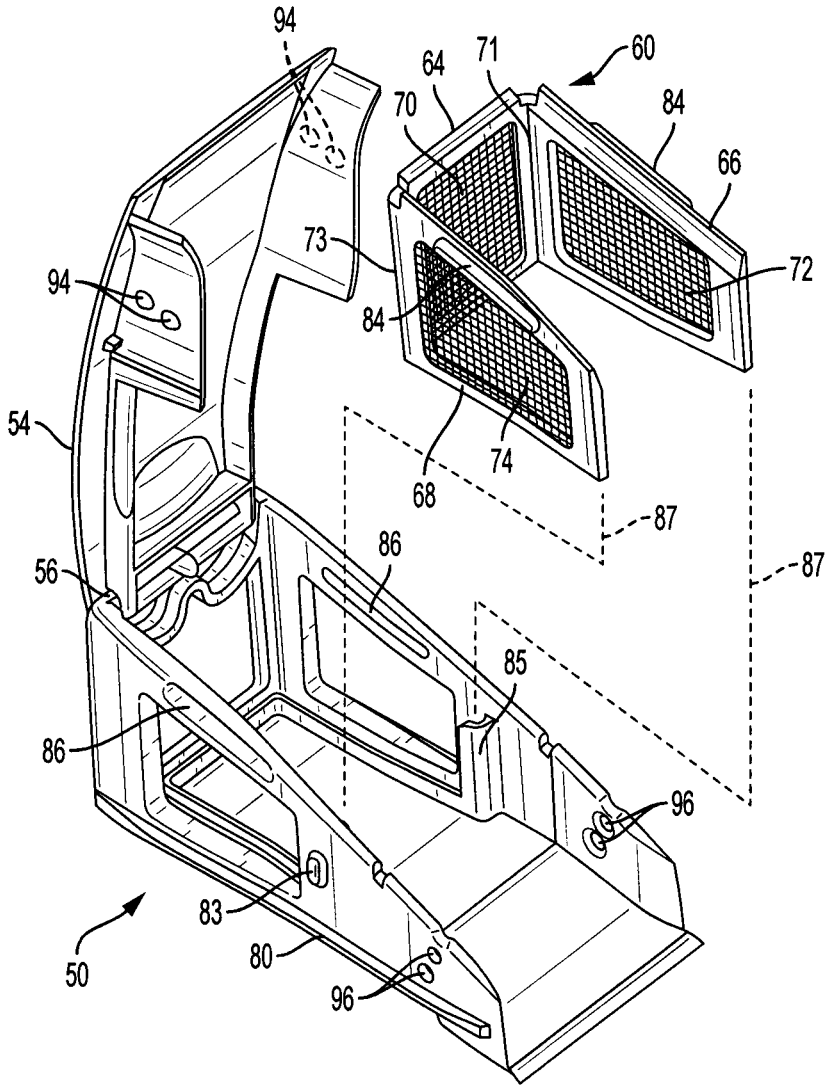
FIG. 1B is another exploded view of part of the hair clipper of FIG. 1A, showing how the debris trap is secured in the debris chamber.
Figure 2:
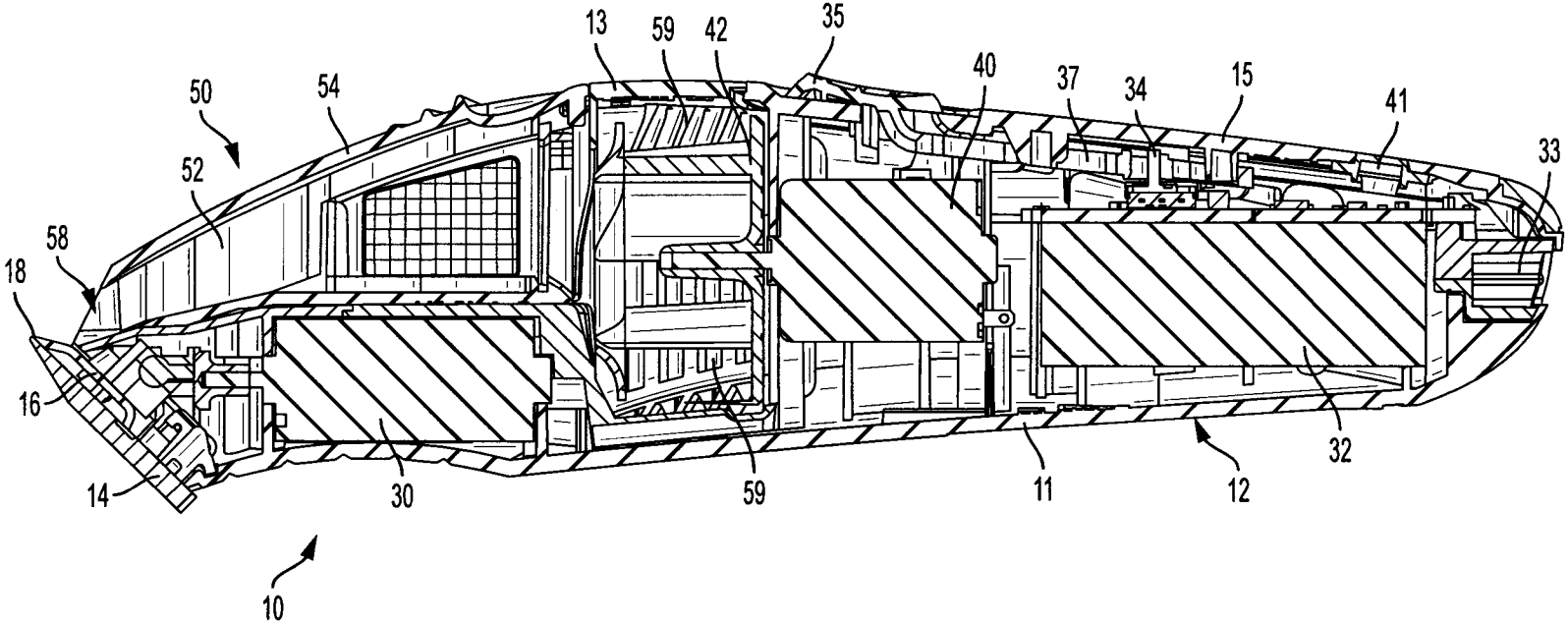
FIG. 2 is an inside view of the hair clipper of FIG. 1, as assembled.

As seen in FIGS. 1 and 2, a hair clipper 10 has a housing 12 that includes a bottom case 11, a top lid 13 and a switch panel 15. The hair clipper 10 also has a stationary blade 14 and a reciprocating blade 16. Both blades have complimentary rows of cutting teeth at an end 18. The cutting blades 14, 16 are secured to the bottom case 11 of the housing 12 in any suitable manner, such as retaining ribs or screws. The blades are secured outside of the housing.

The reciprocating blade 16 is driven back and forth by a motor 30 (FIG. 2), which is powered by a battery 32 through an electrical switch 34. A charging port 33 can be provided, as well as an LED 41 to indicate the battery state, power status and the like.

Figure 7:
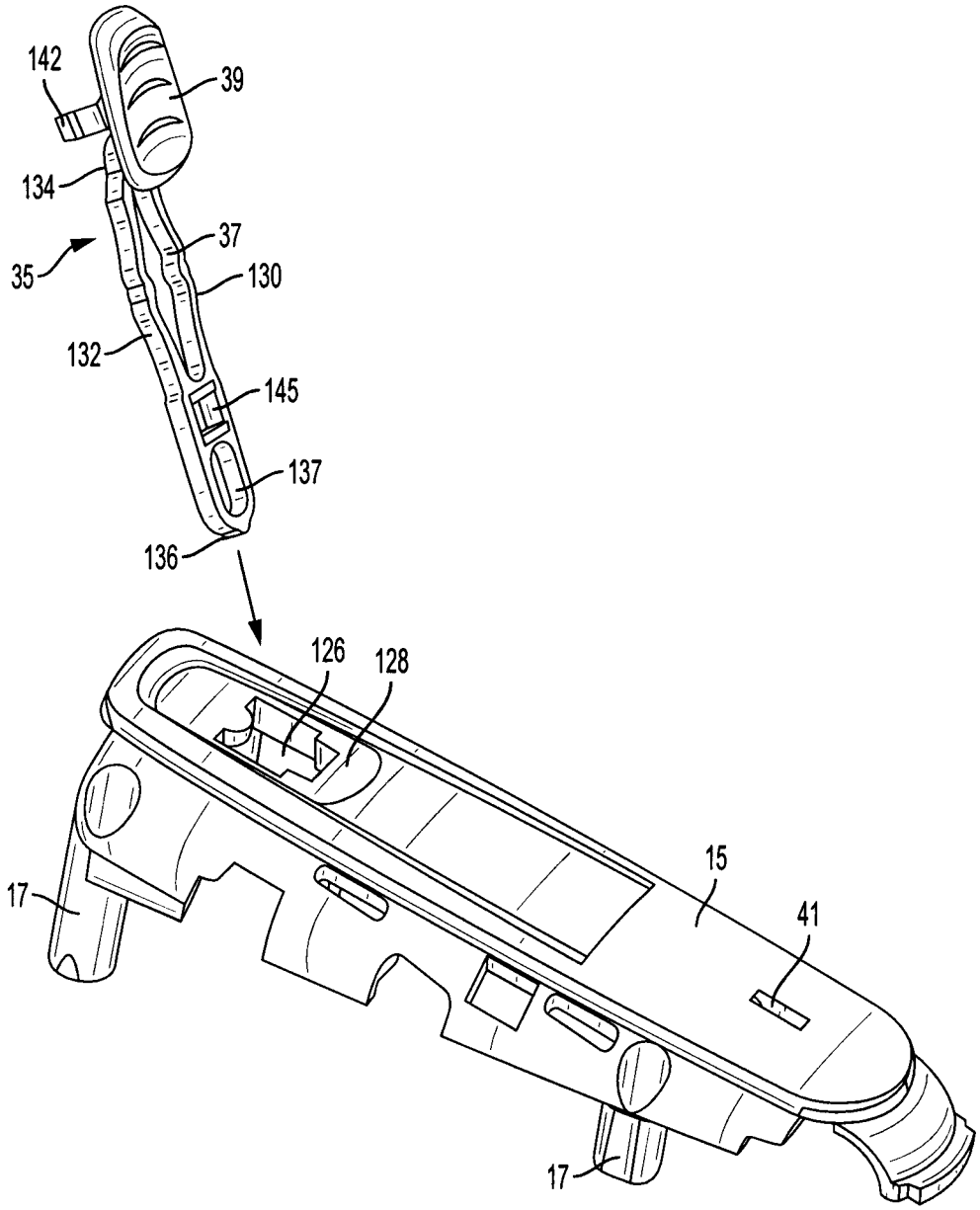
FIG. 7 is an exploded view of the switch actuator assembly in the hair clipper of FIG. 1.

A vacuum system includes another motor 40 having a fan 42 that generates air flow in the housing, as will be described. The motor 40 is also powered by the battery 32 through the switch 34. The switch 34 is part of a switch assembly that controls power to the motors 30 and 40, and includes an actuator 35. The actuator 35 has a yoke 37 inside the housing 12 and a thumb switch 39 that rests outside of the housing 12. The yoke 37 and thumb switch 39 are of one piece construction. The switch assembly also includes the switch panel 15 that is secured to the bottom case 11 of the housing 12 using screws in screw studs 17 (FIG. 7).

The vacuum system has a removable debris chamber 50, shown removed and exploded in FIG. 1A. The debris chamber 50 has a fixed piece 52 and a hinged piece 54. The hinged piece 54 is secured to the fixed piece 52 by a hinge 56. When the hinged portion 54 is closed, as in FIG. 2, the fixed piece 52 and hinged portion 54 form an inlet throat 58 adjacent the cutting blade end 18 for air intake leading into the vacuum system. Rotation of the fan 42 by the motor 40 creates air flow into the intake throat 58, through the debris chamber 50. The air is released from the hair clipper under pressure created by the fan 42 and motor 40 through exhaust vents 59.

The debris chamber 50 has a debris trap 60 that accumulates debris in the chamber 50 and prevents the debris from reaching the motor and exhaust. The trap 60 has a frame 62 with three sides 64, 66 and 68. The side 64 has an edge 71 adjacent the side 66, and an edge 73 adjacent the side 68. An opening is provided in each side 64, 66 and 68, with mesh screens 70, 72 and 74, respectively. The sides 66 and 68 and their respective screens 72 and 74 are preferably perpendicular to the side 64 and its screen 70, and parallel to each other.

The debris on chamber 50 has a pair of rails 80 that slide under a corresponding pair of rails on top lid 82 for mating the debris chamber 50 with the housing top lid 13. Bumps 83 pass over raised portions 90 in the top lid 13 to further secure the debris chamber 50. The rails also facilitate removal of the debris chamber 50 for cleaning. The walls of the chamber 50 are appropriately flexible for adequate securement and removal without excessive effort.

The trap 60 is secured in the debris chamber 50 by placing it inside of L-shaped grooves 85 in the chamber 50 and engaging protrusions 84 (in the sides 66, 68) over openings 86 (in the chamber 50). Dash lines 87 indicate how the trap 60 is installed.

Figure 3B:
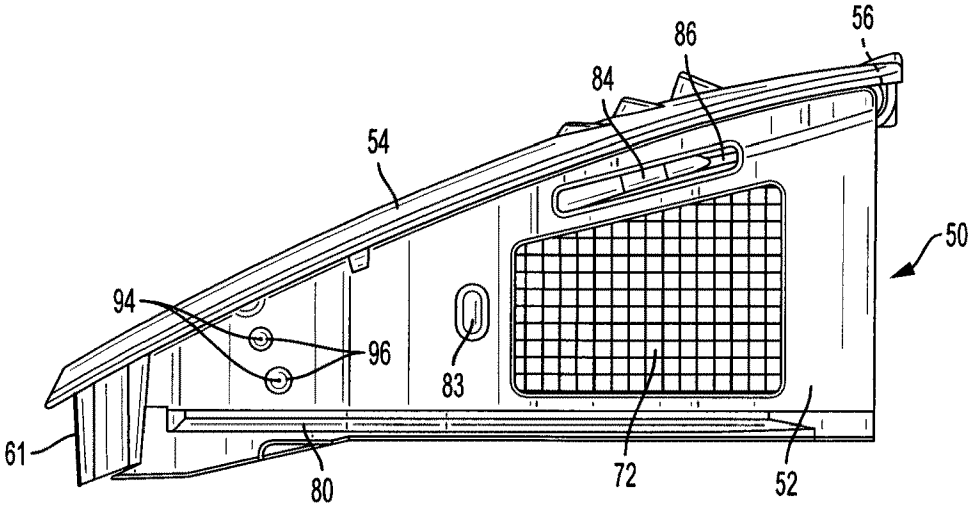
FIG. 3B is a side view of the debris trap as shown in FIG. 3A.
Figure 3A:
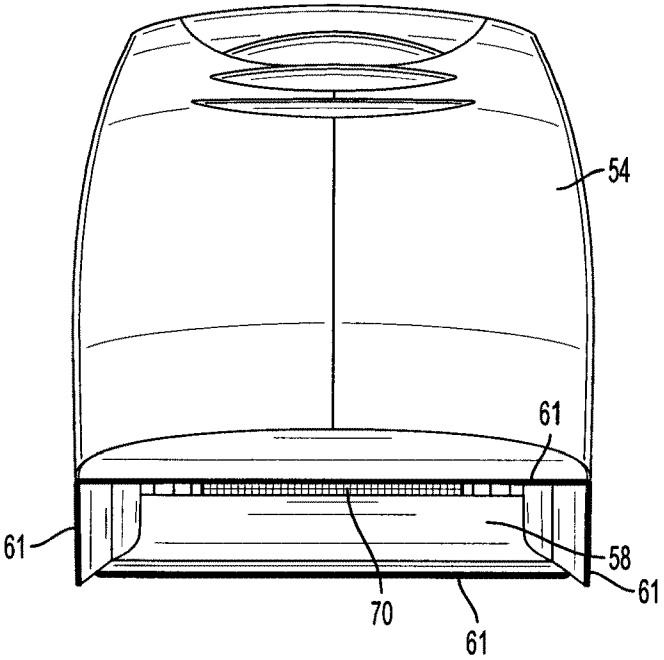
FIG. 3A is a front view of the debris trap in the hair clipper of FIG. 1, shown with a narrow air inlet.
Figure 4B:
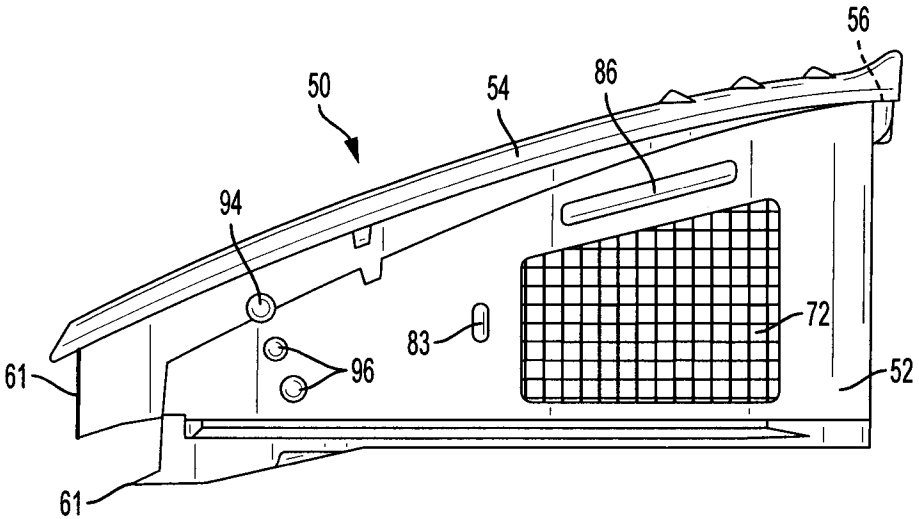
FIG. 4B is a side view of the debris trap as shown in FIG. 4A.
Figure 4A:
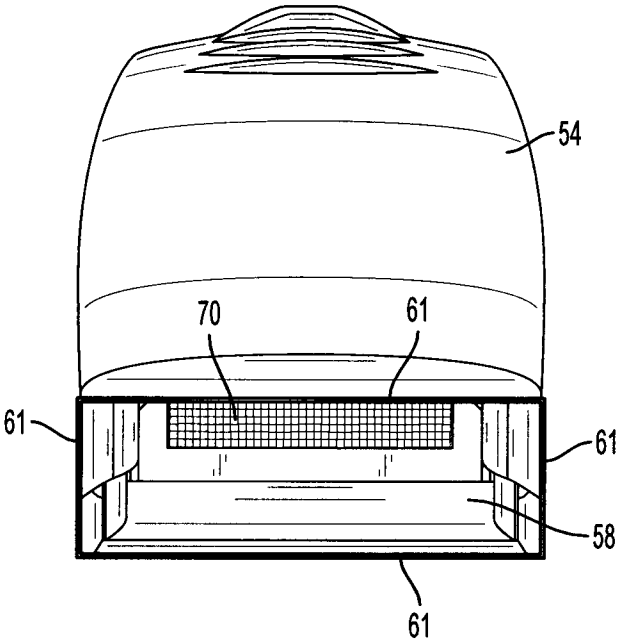
FIG. 4A is front view of the debris trap in the hair clipper of FIG. 1, shown with a wide air inlet.

The hinged portion 54 and fixed piece 52 share the hinge 56 on one end, and a set of bumps 94 (on the hinged portion 54) and holes 96 (on the fixed piece) on the other end. The throat 58 is generally formed along edges 61, outlined in bold lines in FIGS. 3A-3B. The size of the throat 58 can be small, as seen in FIG. 3A, by engaging the bumps 94 and holes 96 in the manner shown in FIG. 3B. The throat 58 can be made larger (FIG. 4A) by lifting the hinged portion 54 and engaging the bumps 94 and holes 96 as shown in FIG. 4B. In this manner, the size of the throat 58 can be adjusted to better capture small debris (in the position shown in FIG. 3A) or large debris (in the position shown in FIG. 4A).

Air flow in the vacuum system will be described primarily in connection with FIGS. 5 and 6. The fan 42 creates a vacuum at the end 18 by drawing air into the chamber 50 through the intake throat 58. The total air flow into the debris chamber 50 is indicated by arrows 100. A primary airflow path (arrows 102) goes through the screen 70, and secondary air flow paths indicated by arrows 104, 105 go through the screens 74, 72 respectively. The primary air flow passes through the opening created by the screen 70. The secondary air flows pass through the screens 72, 74, and openings 108 between the outside of the chamber 50 and the housing top lid 13. The openings 108 restrict the secondary air flows, as will be described.

Figure 5:
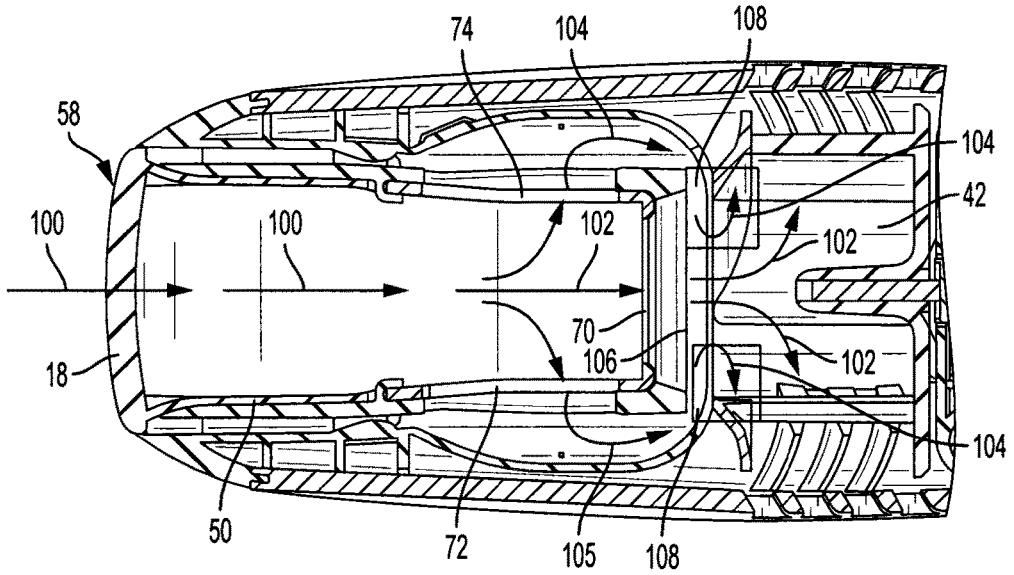
FIG. 5 is diagram showing air flow in the hair clipper of FIG. 1 when there is no debris in the debris trap.

In FIG. 5, there is no debris in the chamber 50, so the primary air flow is stronger than the secondary air flow and incoming debris tends to accumulate in the primary air flow path 102.

Figure 6:
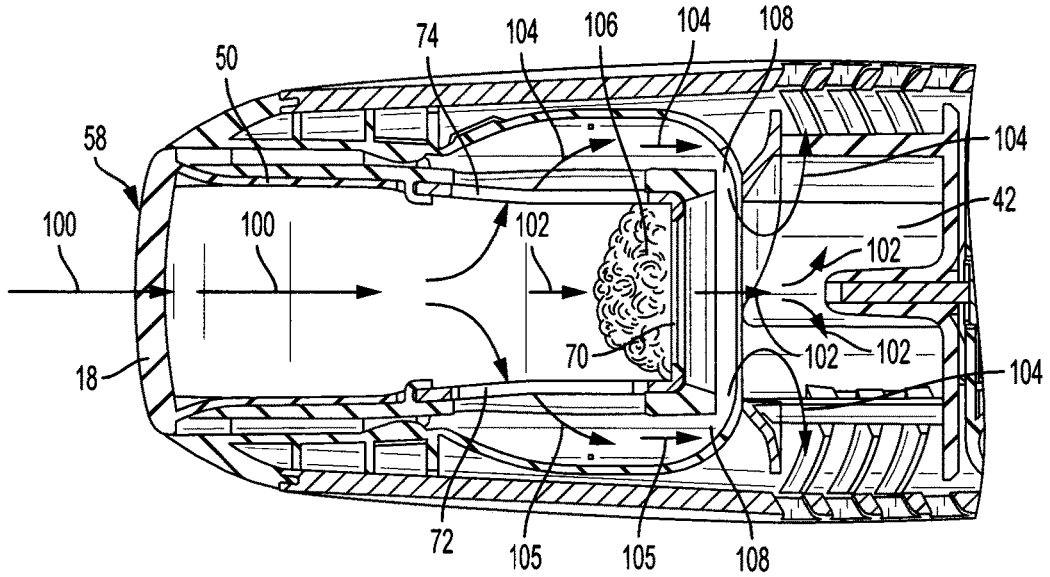
FIG. 6 is a diagram showing air flow in the hair clipper of FIG. 1 when some debris has accumulated in the debris trap.

Referring now to FIG. 6, as debris 106 accumulates, the debris 106 decreases the primary air flow 102, which increases the secondary air flow 104, 105. At that point, debris starts to accumulate adjacent the screens 72 and 74. In this manner, the total air flow remains substantially constant, even when debris 106 accumulates adjacent the screen 70.

The switch panel 15 has an opening 126, seen in FIG. 7. To assemble the switch assembly, the yoke 37 is inserted through the opening 126 until the thumb switch 39 reaches a switch landing 128 on the switch panel 15.

Figure 8A:
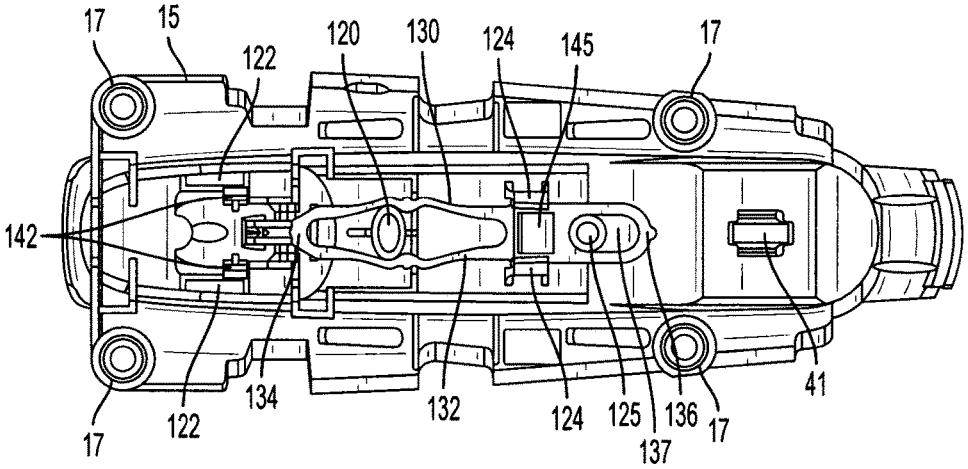
FIG. 8A is a diagram of a switch actuator assembly in the hair clipper of FIG. 1, shown in the off position.
Figure 8B:
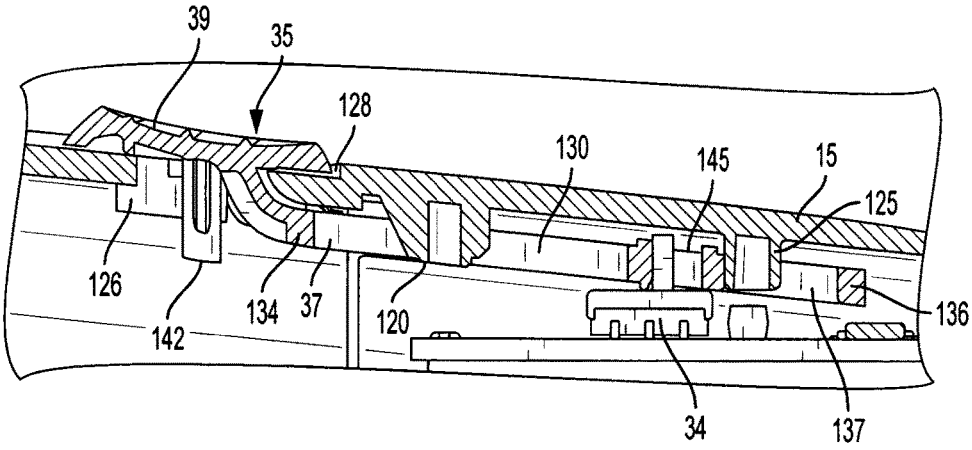
FIG. 8B is a partially cutaway side view of part of the switch actuator assembly of FIG. 8A.

Referring now to FIGS. 8A and 8B, the switch panel 15 has a peg 120, a pair of opposed walls 122 and a pair of projecting barbs 124. The barbs 124 are flexible, and secure the yoke 37 when it is pushed between the barbs 124. A post 125 provides movement limits for the switch actuator 35.

The yoke 37 surrounds the peg 120 with a first flexible beam 130 and a second flexible beam 132. The beams 130, 132 are joined to each other at ends 136 and 134. The switch actuator 35 has barbs 142 that engage the walls 122 in the switch panel 15 to prevent the switch actuator 35 from falling out. The barbs 124 engage the end 136 of the switch actuator 35. The switch 34 fits in an opening 145 in the switch actuator 35, and the post 125 fits in an opening 137.

Figure 9A:
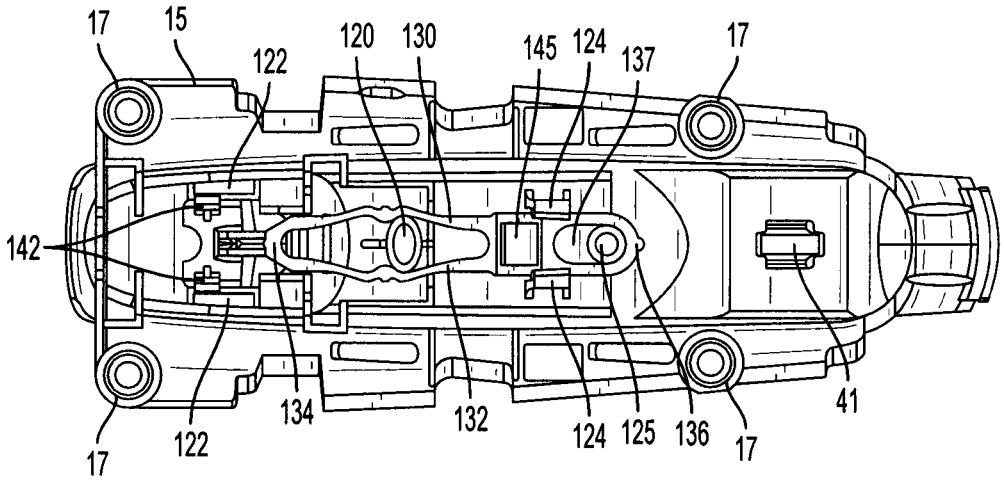
FIG. 9A is a diagram of the switch actuator assembly of FIG. 8A in the on position.
Figure 9B:
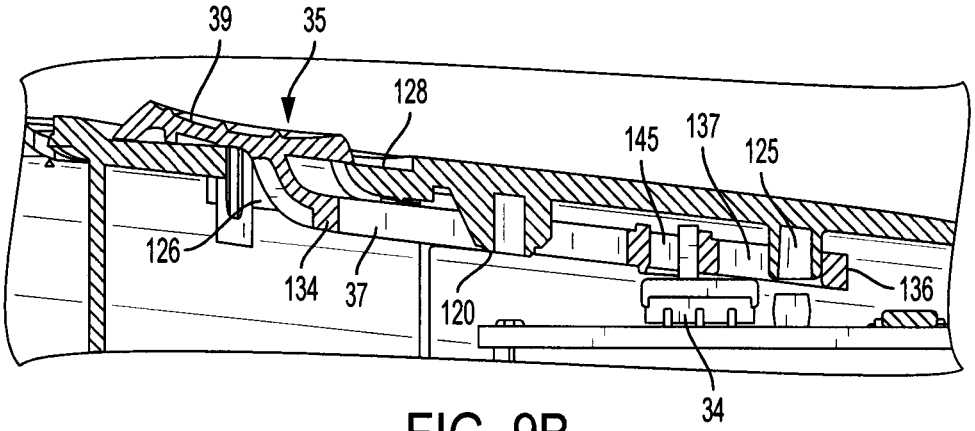
FIG. 9B is a partially cutaway side view of part of the switch actuator assembly of FIG. 8A.

The switch is shown in the off position in FIGS. 8A and 8B, and the on position in FIGS. 9A and 9B. When assembled the yoke 37 is inside of the housing 12, and the thumb switch 39 is outside of the housing 12.

Figure 10:
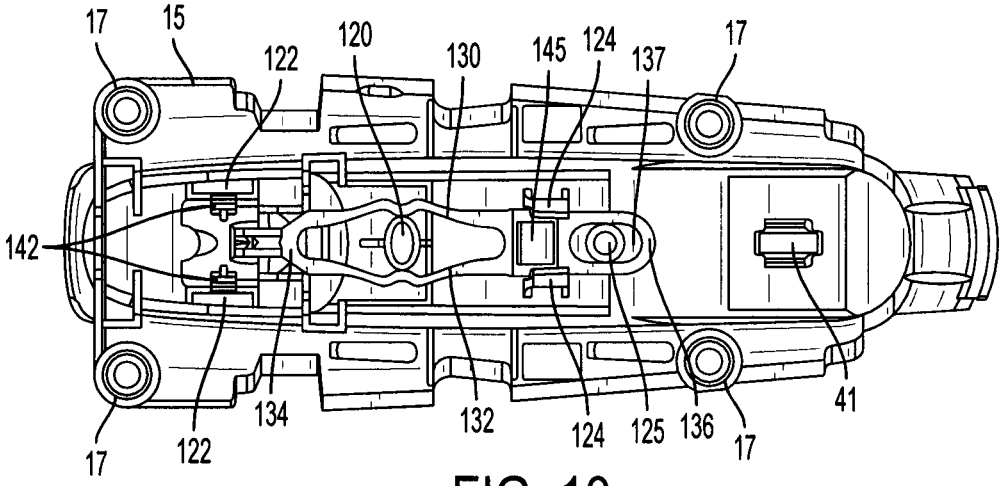
FIG. 10 is a diagram of the switch actuator assembly of FIG. 8A, between the on and off positions.

FIG. 10 shows the yoke passing the peg 120 as the yoke moves between the on and off positions. The first and second flexible beams 130, 132 bend outwardly as they pass the post 120. Their flexure insures that the yoke 37 finishes its movement to the desired on position or off position of the switch 34.

While the principles of the invention have been described above in connection with specific apparatus and applications, it is to be understood that this description is made only by way of example and not as a limitation on the scope of the invention.

What is claimed is:

1. A hair clipper comprising a housing, cutting blades secured to the housing outside of the housing, and a vacuum system having:

an air flow generator in the housing, an air inlet adjacent to the cutting blades leading inside the housing, the air flow generator creating a total air flow that draws air from the cutting blades into the housing, an air exhaust in the housing that releases the total air flow under pressure created by the air flow generator, and a debris chamber between the air flow generator and the air inlet, the debris chamber having a primary air flow path and at least one secondary air flow path, wherein a primary air flow through the primary air flow path is higher than a secondary air flow through the secondary air flow path before debris accumulates in the debris trap, the primary air flow decreasing as debris accumulates in the first air flow path, whereupon some debris accumulates in the secondary air flow path as air is diverted through the secondary air flow path, and wherein the debris chamber includes a first screen perpendicular to the primary air flow path, the primary air flow passing through the first screen, the first screen having a first edge and a second edge, a second screen adjacent the first edge and perpendicular to the first screen, and a third screen adjacent the second edge and perpendicular to the first screen, the secondary air flow being divided between the second and third screens and passing through the second and third screens, wherein the debris chamber has a hinged piece and a fixed piece that share a hinge on one end and form the air inlet on the other end, wherein the hinged piece has a set of bumps and the fixed piece has a set of corresponding holes, wherein the set of bumps and the set of corresponding holes are on the other end, whereby a size of the air inlet is manually adjustable, the size of the air inlet being determined by inserting selected bumps into selected holes.

2. The hair clipper of claim 1, further comprising:

a switch assembly for controlling power to the air flow generator; the switch assembly having an electrical switch secured to the housing;

a switch panel forming part of the housing; and a switch actuator that controls the electrical switch, the switch actuator having a yoke inside the housing and a thumb switch outside of the housing, the yoke and the thumb switch being secured to each other through an opening in the switch panel, the switch actuator further having an opening for insertion of the electrical switch.

3. The hair clipper of claim 1, wherein the housing includes a bottom case, a top lid and a switch panel.

4. The hair clipper of claim 1, wherein the debris chamber includes the fixed piece and the hinged piece, the hinged piece being secured to the fixed piece by a hinge, such that when the hinged piece is closed, the fixed piece and the hinged piece form an inlet throat adjacent the cutting blades for air intake into the vacuum system.

5. The hair clipper of claim 1, wherein the debris chamber has a debris trap that accumulates debris in the debris chamber, the debris trap having a frame with a first side having a first opening and the first screen in the first opening, a second side having a second opening and the second screen in the second opening, and a third side having a third opening and the third screen in the third opening.

6. The hair clipper of claim 5, wherein the second and third sides are perpendicular to the first side, the second and third sides extend from opposing edges of the first side, and the second and third sides are parallel to each other.

* * * * *